US012085326B2

(12) United States Patent
Lee et al.

(10) Patent No.: US 12,085,326 B2
(45) Date of Patent: Sep. 10, 2024

(54) REFRIGERATOR WITH VENTURI DUCT BETWEEN COMPARTMENTS

(71) Applicant: Samsung Electronics Co., Ltd., Suwon-si (KR)

(72) Inventors: Joo Yong Lee, Suwon-si (KR); Il Sung Bae, Suwon-si (KR); Hyo Ju Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 499 days.

(21) Appl. No.: 17/291,982

(22) PCT Filed: Oct. 31, 2019

(86) PCT No.: PCT/KR2019/014542
§ 371 (c)(1),
(2) Date: May 6, 2021

(87) PCT Pub. No.: WO2020/096269
PCT Pub. Date: May 14, 2020

(65) Prior Publication Data

US 2022/0011035 A1 Jan. 13, 2022

(30) Foreign Application Priority Data

Nov. 8, 2018 (KR) ..... 10-2018-0136284

(51) Int. Cl.
*F25D 11/02* (2006.01)

(52) U.S. Cl.
CPC ..... *F25D 11/02* (2013.01); *F25D 2317/067* (2013.01)

(58) Field of Classification Search
CPC ..... F25D 11/02; F25D 2317/067; F25D 2317/0666; F25D 17/065; F25D 23/061
See application file for complete search history.

(56) References Cited

U.S. PATENT DOCUMENTS 6,694,758 B1 2/2004 Cho et al.
2017/0108264 A1 4/2017 Luo

FOREIGN PATENT DOCUMENTS

JP 10-148458 A 6/1998
KR 20-1989-0003180 U 4/1989
(Continued)

OTHER PUBLICATIONS

Korean Intellectual Property Office, "Office Action," issued Jun. 2, 2023, in connection with Korean Patent Application No. 10-2018-0136284, 21 pages.
(Continued)

*Primary Examiner* — Travis Ruby

(57) ABSTRACT

A refrigerator according to one embodiment of the present invention comprises: a main body; a first storage chamber and a second storage chamber provided in the main body so that the front surfaces thereof are opened; an evaporator which is disposed inside the main body and which generates cold air; a first duct for supplying the cold air to the first storage chamber; a second duct for supplying the cold air to the second storage chamber; and a connecting duct for connecting the first duct and the second duct so as to allow the cold air generated by the evaporator to flow to the second duct, wherein the second duct includes a connecting port connected to the connecting duct, a discharge port through which the cold air is discharged, a discharge path for connecting the connecting port and the discharge port, and a connecting path for connecting the inside of the second storage chamber and the discharge path, the discharge path includes a minimum region in which the cross sectional area thereof in a vertical direction or a longitudinal direction is minimized, and the connecting path is provided to connect the inside of the second storage chamber and the minimum region.

8 Claims, 8 Drawing Sheets

(56) References Cited

FOREIGN PATENT DOCUMENTS

| | | | |
|---|---|---|---|
| KR | 20-0122407 | Y1 | 8/1998 |
| KR | 20-2000-0005548 | U | 3/2000 |
| KR | 10-0390426 | B1 | 7/2003 |
| KR | 10-2004-0017131 | A | 2/2004 |
| KR | 20070016321 | A | 2/2007 |
| KR | 10-2010-0008598 | A | 1/2010 |
| KR | 10-2011-0041659 | A | 4/2011 |
| KR | 20130136205 | A | 12/2013 |
| KR | 20170065948 | A | 6/2017 |
| KR | 20180072146 | A | 6/2018 |

OTHER PUBLICATIONS

International Search Report dated Mar. 3, 2020 in connection with International Patent Application No. PCT/KR2019/014542, 2 pages.
Office Action dated Sep. 26, 2023, in connection with Korean Patent Application No. 10-2018-0136284, 4 pages.

REFRIGERATOR WITH VENTURI DUCT BETWEEN COMPARTMENTS

CROSS-REFERENCE TO RELATED APPLICATIONS

This application is a 371 of International Application No. PCT/KR2019/014542 filed on Oct. 31, 2019, which claims priority to Korean Patent Application No. 10-2018-0136284 filed on Nov. 8, 2018, the disclosures of which are herein incorporated by reference in their entirety.

BACKGROUND

1. Field

The disclosure relates to a refrigerator that uses a single evaporator to control temperature of a storage chamber.

2. Description of Related Art

Refrigerators are home appliances equipped with a main body having a storage chamber, a cold air supplier for supplying cold air to the storage chamber and a door for opening or closing the storage chamber to keep food fresh. The storage chambers include a fridge maintained at temperatures of about 0 to 5 degrees Celsius for keeping groceries cool, and a freezer maintained at temperatures of about 0 to −30 degrees Celsius for keeping groceries frozen.

The refrigerators may be divided by the positions of the fridge and freezer into bottom mounted freezer (BMF) type refrigerators with the freezer located below while the fridge located above, top mounted freezer (TMF) type refrigerators with the freezer located above while the fridge located below, and side by side (SBS) type refrigerators with the freezer and fridge located in parallel in the left-and-right direction. Further, depending on the number of doors, they may further be divided into two-door, three-door, four-door refrigerators, and so on.

Respective evaporators may be installed in the fridge and the freezer to supply cold air to the fridge and the freezer. Alternatively, cold air may be respectively supplied to the fridge and the freezer through a single evaporator.

An aspect of the disclosure provides a refrigerator in which a structure of a cold air supply device is simply enhanced so that cold air is supplied to a fridge and a freezer through a single evaporator.

It also provides a refrigerator with ducts enhanced to prevent dew condensation on the fridge and freezer ducts, which otherwise occurs due to a difference in temperature between the fridge and freezer ducts.

SUMMARY

According to an embodiment of the disclosure, a refrigerator includes a main body, first and second storage chambers with front sides open in the main body, an evaporator arranged in the main body to produce cold air, a first duct supplying cold air into the first storage chamber and a second duct supplying cold air to the second storage chamber, and a connecting duct connecting the first duct to the second duct to move the cold air produced from the evaporator to the second duct, wherein the second duct includes a connecting port connected to the connecting duct, a discharge port through which the cold air is discharged, a discharge path connecting the connecting port to the discharge port, and a connecting path connecting inside of the second storage chamber to the discharge path, and wherein the discharge path includes a smallest area with a smallest cross-section in a vertical direction or in a front-to-back direction, and the connection flow path is arranged to connect the inside of the second storage chamber to the smallest area.

Air inside the second storage chamber flows into the second duct along the connecting path.

The second duct includes a protruding part protruding forward, the discharge port is arranged in a front plane of the protruding part, and an one end of the connecting path is arranged in a bottom plane of the protruding part.

The connecting path extends upward from the one end of the connecting path, and the other end of the connecting path is connected to the smallest area.

At least a portion of the discharge path is arranged inside the protruding part, and some other portions of the discharge path extends downward.

The first storage chamber and the second storage chamber arranged side by side in the left-to-right direction, and the first duct is arranged on a rear side of the first storage chamber and the second duct is arranged on a rear side of the second storage chamber.

The evaporator is arranged in the back of the first storage chamber.

The refrigerator further includes a first inner case defining the first storage chamber, a second inner case defining the second storage chamber, and a cooling path formed between the rear side of the first storage chamber and a rear side of the first inner case.

The first duct is connected to the cooling path, and the first duct includes a blower fan provided for cold air in the cooling path to flow into the first duct and the second duct.

The first duct includes a discharge port arranged adjacent to the second duct and connected to the connecting duct, and at least a portion of the cold air brought into the first duct flows into the first storage chamber and the other portions flows into the second duct through the discharge port.

The refrigerator further includes an auxiliary blower fan arranged adjacent to the smallest area for air in the second storage chamber to flow into the smallest area through the connecting path.

According to an embodiment of the disclosure, a refrigerator includes a main body, a freezer and a fridge arranged on the left and right in the main body, a cooling path formed behind the freezer and having an evaporator arranged to produce cold air, a first duct connected to the cooling path to supply cold air to the freezer, a second duct supplying cold air to the fridge, and a connecting duct connecting the first duct to the second duct to move cold air in the first duct to the second duct, wherein the second duct includes a connecting port connected to the connecting duct, a discharge port through which the cold air is discharged, a discharge path connecting the connecting port to the discharge port, and a connecting path connecting inside of the fridge to the discharge path, wherein the discharge path includes a smallest area with a smallest cross-section in a vertical direction or in a front-to-back direction, and wherein the connecting path connects the inside of the second storage chamber to the smallest area so that air in the fridge flows into the smallest area along the connecting path.

The second duct includes a protruding part protruding forward, the discharge port is arranged in a front plane of the protruding part, and an end of the connecting path is arranged in a bottom plane of the protruding part.

The connecting path extends upward from the one end of the connecting path, and the other end of the connecting path is connected to the smallest area.

At least a portion of the discharge path is arranged inside the protruding part, and some other portions of the discharge path extends downward.

According to an embodiment of the disclosure, dew condensation that is otherwise formed inside the fridge duct may be prevented by controlling temperature in the fridge duct through a connecting path connecting a fridge duct to the fridge.

DETAILED DESCRIPTION

Figure 1:
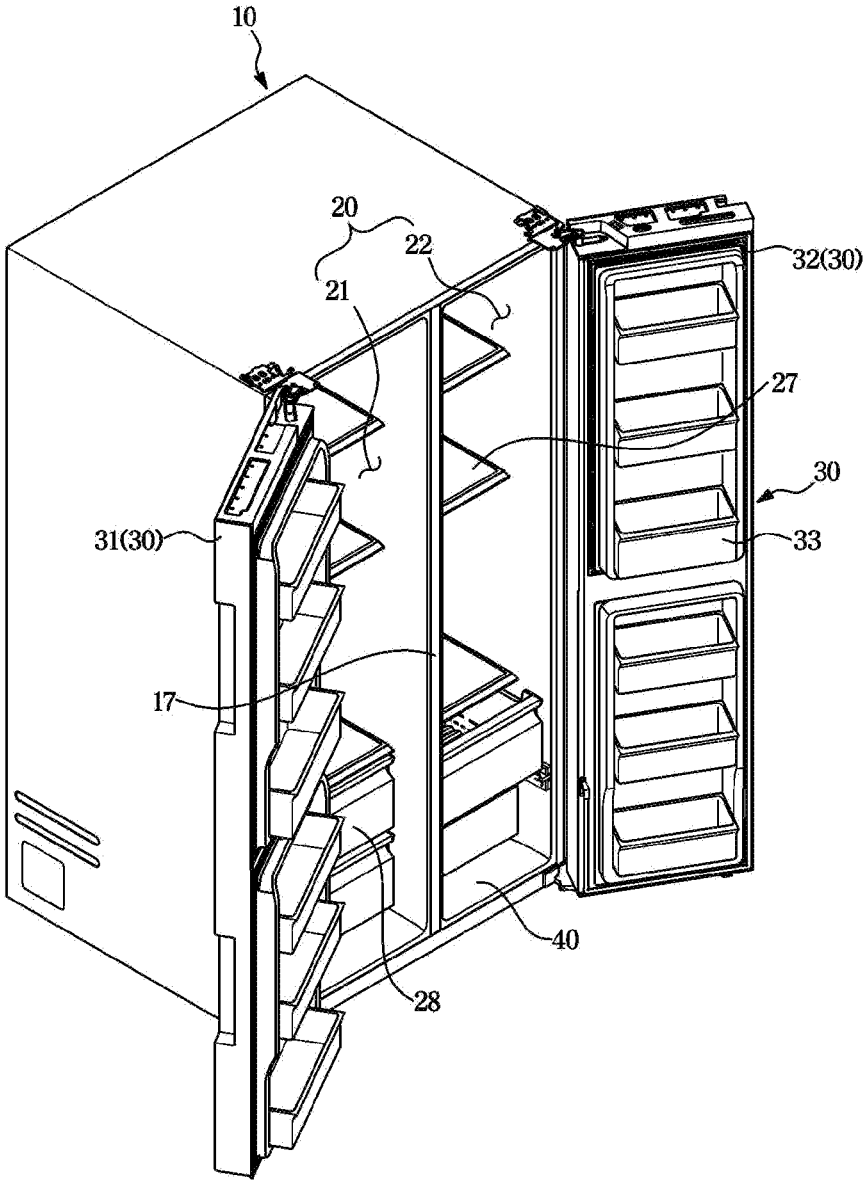
FIG. 1 is a perspective view of a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Embodiments of the present disclosure will now be described in detail with reference to accompanying drawings.

Figure 2:
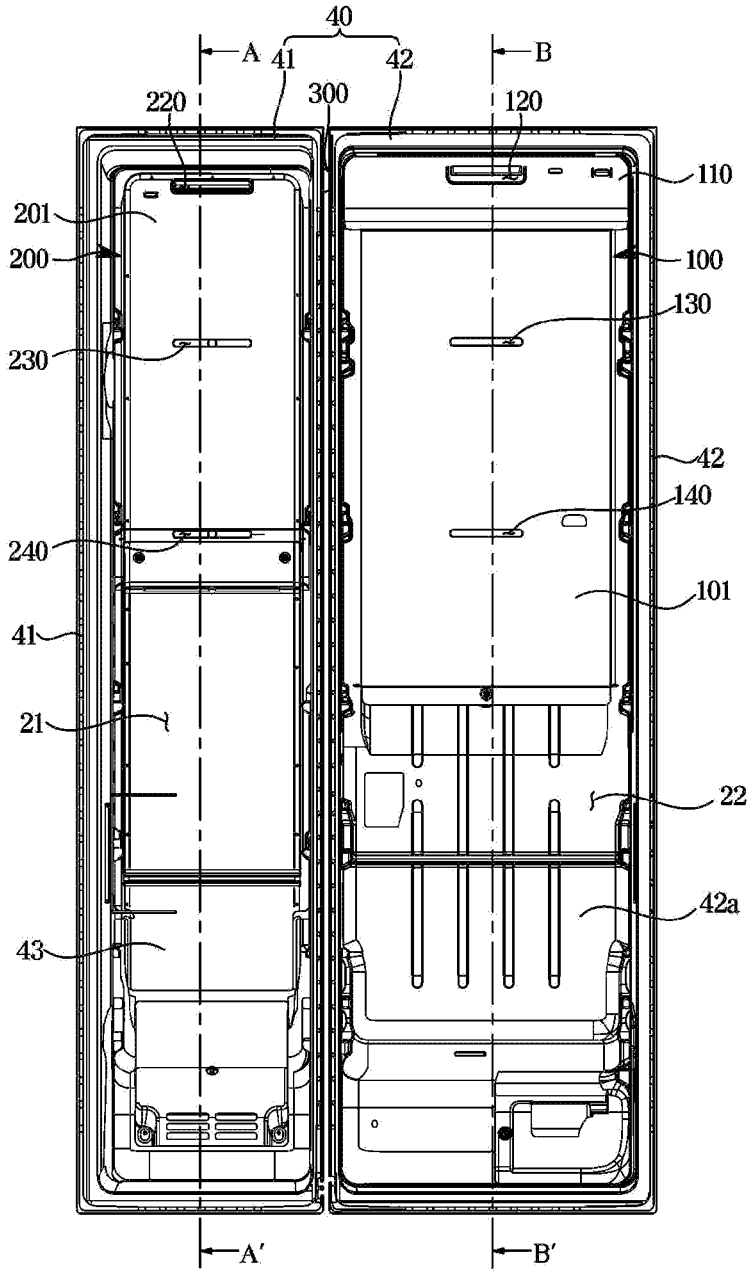
FIG. 2 is a front view of a portion of a refrigerator, according to an embodiment of the present disclosure.
Figure 3:
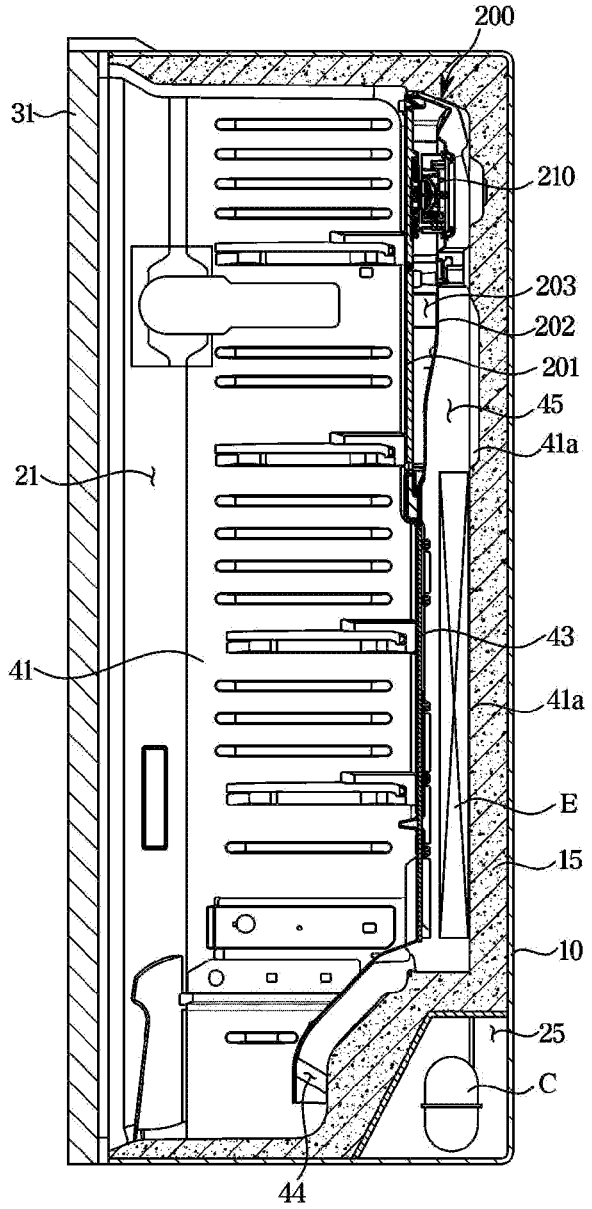
FIG. 3 is a side cross-sectional view along AA' marked in FIG. 2.
Figure 4:
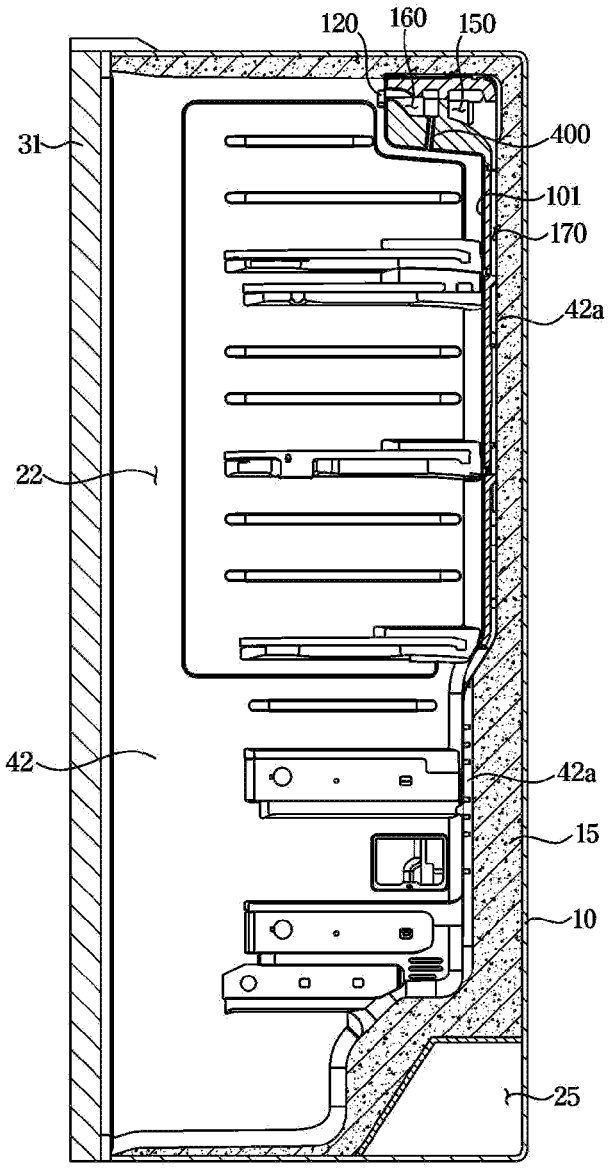
FIG. 4 is a side cross-sectional view along BB' marked in FIG. 2.
Figure 5:
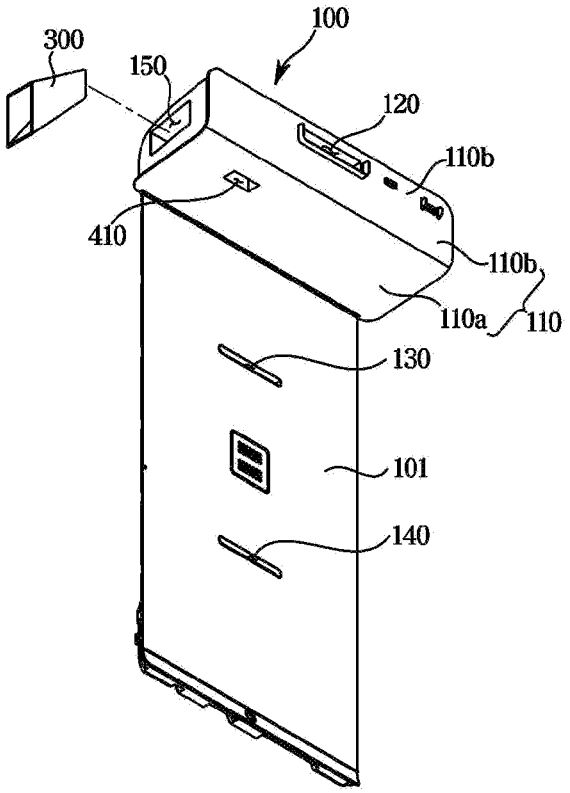
FIG. 5 shows a fridge duct and a connecting duct, according to an embodiment of the disclosure.

FIG. 1 is a perspective view of a refrigerator, according to an embodiment of the disclosure, FIG. 2 is a front view of a portion of a refrigerator, according to an embodiment of the present disclosure, FIG. 3 is a side cross-sectional view along AA' marked in FIG. 2, FIG. 4 is a side cross-sectional view along BB' marked in FIG. 2, and FIG. 5 shows a fridge duct and a connecting duct, according to an embodiment of the disclosure.

As shown in FIGS. 1 to 5, a refrigerator includes a main body 10 that forms the exterior (or referred to as an outer case), a storage chamber 20 with an open front, which is formed inside the main body 10 and contains a e.g., storage box 28, and a door 30 rotationally coupled with the main body 10 to open/close the open front of the storage chamber 20.

The main body 10 includes an inner case 40 that defines the storage chamber 20, and a cold air supply device for supplying cold air to the storage chamber 20.

The cold air supply device may include a compressor C, a condenser (not shown), an expansion valve (not shown), and an evaporator E, and an insulation member 15 is foamed and filled between the main body 10 and the inner case 40 and within the door 30 to prevent leakage of cold air.

The storage chamber 20 is provided to have an open front inside the main body 10, and the open front is opened or closed by the door 30.

The storage chamber 20 may be partitioned by a partition wall 17 into a plurality of spaces. The storage chamber 20 may include a freezer 21 and the fridge 22 separated by the partition wall 17 in the left-to-right direction.

The inner case 40 may include a freezer inner case 41 defining the freezer 21 and a fridge inner case 42 defining the fridge 22. The freezer inner case 41 and the fridge inner case 42 may be arranged side by side on the left and right from a center of the partition wall 17.

A machine room 25 in which the compressor C and the condenser (not shown) for compressing refrigerant and condensing the compressed refrigerant are installed is provided behind and underneath the storage chamber 20.

In the storage chamber 20, there may be a plurality of shelves 27 and the storage box 28 to store e.g., foods.

The door 30 is rotationally coupled with the main body 10 to open or close the open front of the storage chamber 20. The freezer 21 and the fridge 22 may be opened or closed by the first door 31 and the second door 32 rotationally coupled to the main body 10, respectively.

Although the refrigerator may be equipped with French doors in an embodiment of the disclosure, it may be of a top mounted freezer (TMF) type in which the freezer 21 and the fridge 22 are arranged up and down or a bottom mounted freezer (BMF) type in which the fridge 22 and the freezer 21 are arranged up and down.

It is not, however, limited thereto, but the storage chamber 20 may be partitioned by the partition wall 17 into three or more.

On the rear side of the door 30, a plurality of door guards 33 may be provided to contain e.g., foods.

A freezer duct 200 for supplying cold air to the freezer 21 may be arranged on an inner side of the freezer 21. A fridge duct 100 for supplying cold air to the fridge 22 may be arranged on an inner side of the fridge 22.

The freezer duct 200 may be arranged on the back and at top end of the freezer 21. A separation plate 43 that forms the rear side of the freezer 21 together with the freezer duct 200 may be arranged underneath the freezer duct 200.

The freezer duct 200 and the separation plate 43 may be arranged in front of a rear side 41*a* of the freezer inner case. Accordingly, a cooling space 45 may be formed between the freezer duct 200, the separation plate 43 and the rear side 41*a* freezer inner case.

The evaporator E may be arranged in the cooling space 45. It may also form a fluid path for the cold air produced from the evaporator E to flow into the freezer duct 200.

The freezer 21 may be formed by inner surfaces of the freezer inner case 41, a front surface 201 of the freezer duct 200, and the separation plate 43. Specifically, the rear surface of the freezer 21 may be formed by the front surface 201 of the freezer duct 200 and the separation plate 43, and side surfaces of the freezer 21 may be formed by the inner surfaces of the freezer inner case 41.

The freezer duct 200 may include an inner space 203 formed between the front surface 201 and a rear surface 202. The freezer duct 200 may include a blower fan 210 arranged on the rear surface 202 to force the cold air produced in the cooling space 45 to flow into the freezer duct 200.

The cold air in the cooling space 45 may be moved upward by the blower fan 210 and brought into the freezer duct 200 through the blower fan 210.

The cold air brought into the inner space 203 may be released into the freezer 21 by the blower fan 210 through freezer discharge ports 220, 230, and 240 of the freezer duct 200.

The cold air produced in the cooling space 45 may have a temperature of about −20 degrees, and may be released by the blower fan 210 directly into the freezer 21 to cool down the freezer 21.

The fridge duct 100 may be arranged in an upper portion of the rear side of the fridge 22. A rear side 42*a* of the fridge inner case that forms the rear side of the fridge 22 together with the fridge duct 100 may be arranged underneath the fridge duct 100.

The fridge 22 may be formed by inner surfaces of the fridge inner case 42, a front surface 101 of the fridge duct 100, and the rear side 42*a* of the fridge inner case. Specifically, the rear side of the fridge 22 may be formed by the front surface 101 of the fridge duct 100 and the rear side 42*a* of the fridge inner case, and side surfaces of the fridge 22 may be formed by the inner surfaces of the fridge inner case 42.

A space may be formed between the front surface 101 of the fridge duct 100 and the rear side 42*a* of the fridge inner case. A second discharge path 170, as will be described later, may be formed in the space.

No evaporator for supplying cold air is included in the side of the fridge duct 100. Hence, the cold air produced from the evaporator E connected to the freezer duct 200 is moved into the fridge duct 100 through the freezer duct 200 and then released from the fridge duct 100, to keep the fridge 22 at a low temperature.

A connecting duct 300 may be included between the freezer duct 200 and the fridge duct 100 to connect the freezer duct 200 to the fridge duct 100 such that cold air in the freezer duct 200 may be moved to the fridge duct 100.

An end of the connecting duct 300 may be connected to a discharge port (not shown) of the freezer duct 200 through which the cold air in the freezer duct 200 is discharged, and the other end of the connecting duct 300 may be connected to a connecting port 150 of the fridge duct 100 connected to the connecting duct 300 such that the cold air may be brought in from the freezer duct 200.

The air cooled down in the cooling space 45 may be moved into the freezer duct 200 by the blower fan 210, and some of the cold air having been brought into the freezer duct 200 may be released to the freezer through the discharge ports 220, 230, and 240 of the freezer duct 200 while others may be brought into the fridge duct 100 through the connecting duct 300.

As described above, the cold air produced in the cooling space 45 is kept at about −20 degrees, and the fridge needs to remain at about zero or higher temperature. Accordingly, only a certain amount of cold air is brought into the fridge duct 100 and released to the fridge 22.

Although not shown in the drawings, the connecting duct 300 may include an open/close part (not shown) to allow the cold air to be brought in or block the cold air from being brought in to keep the temperature of the inside of the fridge 22 at a certain temperature.

The fridge duct 100 may include a protruding part 110 protruding forward, and a front surface 101 extending downward from the back of the protruding part 110.

The connecting port 150 connected to the connecting duct 300 may be arranged on a side of the protruding part 110. The connecting port 150 may be arranged on a side of the protruding part 110 adjacent to the freezer duct 200.

A discharge port 120 may be arranged on a front side 110*b* of the protruding part 110, through which to release the cold air having been brought in through the connecting port 150 to the fridge 22.

A discharge path 160 connecting the connecting port 150 to the discharge port 120 may be arranged inside of the protruding part 110. The cold air brought in through the connecting port 150 along the discharge path 160 is discharged through the discharge port 120, thereby maintaining the fridge 22 to a certain temperature.

A side of the discharge path 160 may be connected to the second discharge path 170 extending downward along the front surface 101 of the fridge duct 100. The cold air brought in through the connecting port 150 may be discharged through the discharge port 120, or may be moved to the lower side of the fridge duct 100 along the second discharge path 170.

Additional discharge ports 130 and 140 connected to the second discharge path 170 and formed to release the cold air moved in the second discharge path 170 additionally to the fridge 22 may be arranged on the front surface 101 of the fridge duct 100.

Accordingly, the cold air flowing to the lower side along the second discharge path 170 may be released to the fridge 22 through the additional discharge ports 130 and 140.

A circulation path 44 connected to the machine room 25 and provided to allow the circulated cold air to move into the machine room 25 may be arranged in a lower side of the freezer inner case 41.

A second circulation path (not shown) connected directly to the storage chamber 25 or connected to the lower side of the freezer inner case 41 may be arranged in a lower side of the fridge inner case 42.

The cold air circulated in the freezer 21 and the fridge 22 through the circulation path 44 and the second circulation path (not shown) may be brought back into the machine room 25 and supplied into the freezer 21 and the fridge 22 through the single evaporator E.

The refrigerator duct 100 will now be described in detail.

Figure 6:
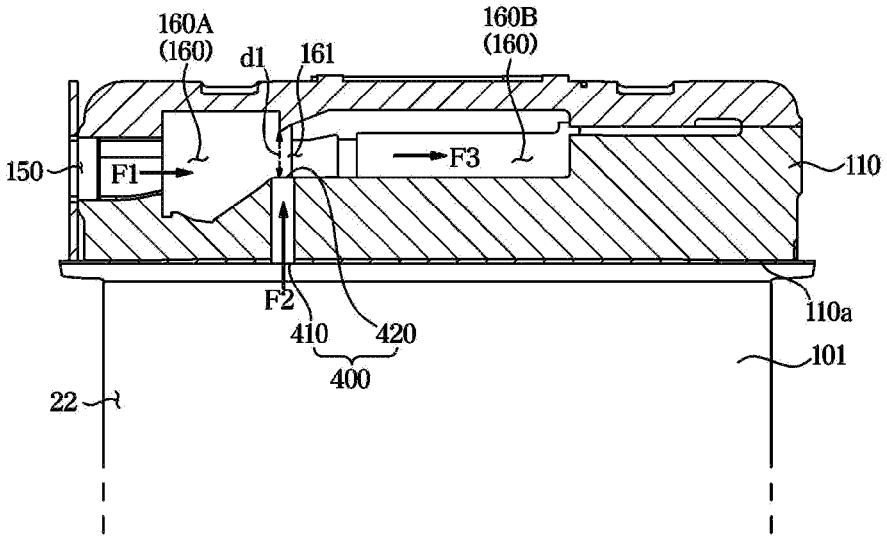
FIG. 6 is a cross-sectional view of a fridge duct in the vertical direction, according to an embodiment of the disclosure.
Figure 7:
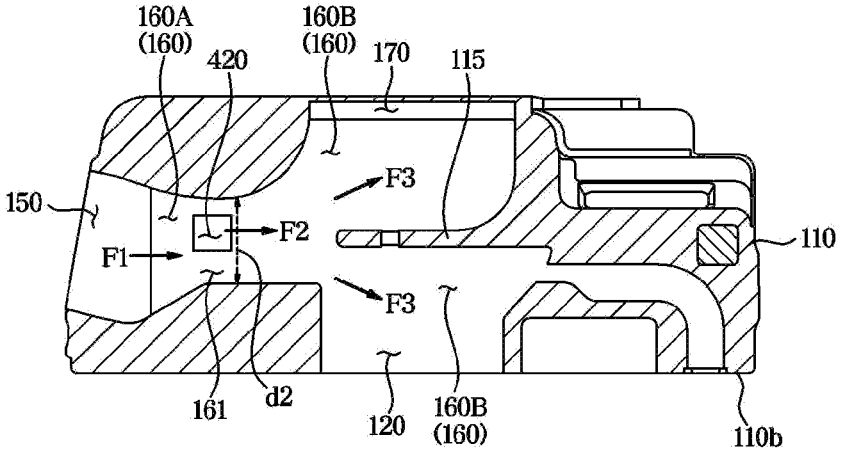
FIG. 7 is a cross-sectional view of a fridge duct in the front-to-back direction, according to an embodiment of the disclosure.

FIG. 6 is a cross-sectional view of a fridge duct in the vertical direction, according to an embodiment of the disclosure, and FIG. 7 is a cross-sectional view of a fridge duct in the front-to-back direction, according to an embodiment of the disclosure.

As described above, the refrigerator according to the embodiment of the disclosure may perform refrigeration cycle using a single evaporator E. Specifically, cold air may be supplied to the fridge 22 by forcing some of the cold air supplied to the freezer 21 to flow into the fridge duct 100.

Cold air of about −20 degrees for cooling down the freezer 21 may flow into the fridge duct 100, and may be moved around in the discharge path 160 before being discharged from the inside of the fridge duct 100 through the discharge port 120 and the additional discharge ports 130 and 140.

In this case, a surface of e.g., an injection molded material defining the inner surface of the discharge path 160 may be cooled down by the cold air, and accordingly, dew condensation may occur on the inner surface of the discharge path 160. The dew condensation occurring in the fridge duct 100 may cause a problem of sanitation of the inside of the fridge 22, and reliability of the refrigerator may be reduced because the moisture may flow into an electric device placed in the fridge duct 100.

Hence, the temperature in the fridge duct 100 needs to be kept at the dew-point temperature or higher. In the conventional case, there is an attempt to solve such problems by thick insulation foaming, for example, but it may cause another problem that reduces the capacity of the storage chamber 20 of the refrigerator.

To solve the problems, in the refrigerator according to an embodiment of the disclosure, the fridge duct 100 may include a connecting path 400 connecting the fridge 22 to the discharge path 160 for the air in the fridge 22 to flow into the discharge path 160 and increase the temperature of the air in the discharge path 160.

The connecting path 400 may extend in the vertical direction. One end 420 of the connecting path 400 may be connected to the discharge path 160, and the other end 410 of the connecting path 400 may extend downward and may be connected to an opening formed at a bottom plane 110*a* of the protruding part 110.

Accordingly, about zero or higher temperature of cold air circulating in the fridge 22 may flow into the discharge path 160 through the other end 410 of the connecting path 400, and in the discharge path 160, cold air F1 brought in from the freezer duct 200 and cold air F2 brought in from the fridge 22 may be mixed into cold air F3 having a temperature higher than the cold air F1 brought in from the freezer duct 200.

The temperature of the cold air F3 higher than the cold air F1 brought in from the freezer duct 200 may be provided to be higher than the dew point temperature of the cold air in order to prevent dew condensation in the fridge duct 100.

The one end 420 of the connecting path 400 may be connected to a smallest area 161 of the discharge path 160 with the smallest cross-section in the vertical direction or in the front-to-back direction, so that the air circulating in the fridge 22 may flow into the fridge duct 100 along the connecting path 400.

The smallest area 161 is a section of the discharge path 160 having gradually decreasing and then increasing cross-sections, a vertical height d1 of the discharge path 160 less than height of the other portions of the discharge path 160, and a length d2 of width of the discharge path 160 in the front-to-back direction smaller than width of the other portions of the discharge path 160.

In an embodiment of the disclosure, the cross-section of the smallest area 161 has the smallest size in the front-to-back direction and the vertical direction, but is not limited thereto, and the cross-section in at least one of the front-to-back direction and the vertical direction may be minimized.

When the cold air flows into the discharge path 160 at a certain pressure, the pressure of the cold air may be reduced due to the Venturi effect in the smallest area 161 having the decreasing cross-section.

In this case, when the pressure in the smallest area 161 is set to be lower than the pressure in the fridge 22, the air of the fridge 22 may flow into the connecting path 400 toward the fridge 22. Accordingly, the air in the fridge 22 may easily flow into the fridge duct 100 without an extra mechanical structure.

The cross-section of the smallest area 161 may be set up variously taking into account the pressure of air in the fridge 22, the pressure in the discharge path 160, etc.

Due to this difference in pressure between the smallest area 161 and inside of the fridge 22, the air F2 in the fridge 22 may flow into the smallest area 161 along the connecting path 400, and the air F1 brought in from the freezer duct 200 and the air F2 in the fridge 22 may be mixed into the air F3 having a temperature higher than the dew point temperature of the cold air in the smallest area 161.

The air F3 having a temperature higher than the dew point temperature of the cold air is discharged through the discharge port 120 or the additional discharge ports 130 and 140 along the second discharge path 170, thereby preventing dew condensation in the discharge path 160 as well as near the discharge port 120 and the additional discharge ports 130 and 140.

The smallest area 161 may be arranged between the connecting port 150 and the discharge port 120. As described above, the smallest area 161 is where the air F1 brought in from the freezer duct 200 and the air F2 in the fridge 22 are mixed, and when the smallest area 161 is arranged farther outside than the discharge port 120 from the connecting port 150, dew condensation may occur due to a decrease in temperature in an area where the discharge path 160 is connected to the discharge port 120.

Hence, it is desirable for the smallest area 161 to be arranged in an area adjacent to the connecting port 150.

Specifically, when, in the discharge path 160, a section between the connecting port 150 and the smallest area 161 is a front section 160A and a section between the smallest area 161 and the discharge port 120 or the second discharge path 170 is a rear section 160B, a length of the front section 160A may be formed as short as possible.

This may allow the air F3, a mixture of the air F1 brought in from the freezer duct 200 and the air F2 in the fridge 22 having a higher temperature than the dew point temperature of the cold air, to flow into the rear section 160B relatively longer than the front section 160A, thereby reducing a probability of dew condensation in the discharge path 160.

As such, more space of the storage chamber 20 may be secured by preventing dew condensation in a way of not adding an insulation member but increasing the temperature of the cold air in the fridge duct 100 to be higher than the dew point temperature of the cold air through the connecting path 400, and reliability of the refrigerator may be further improved by increasing the temperature of the cold air in the fridge duct 100 without including an extra electric component.

The fridge duct 100 of the refrigerator according to an another embodiment of the disclosure will now be described. Overlapping features with those of the fridge duct 100 in accordance with the previous embodiment of the disclosure will not be repeated in the following description.

Figure 8:
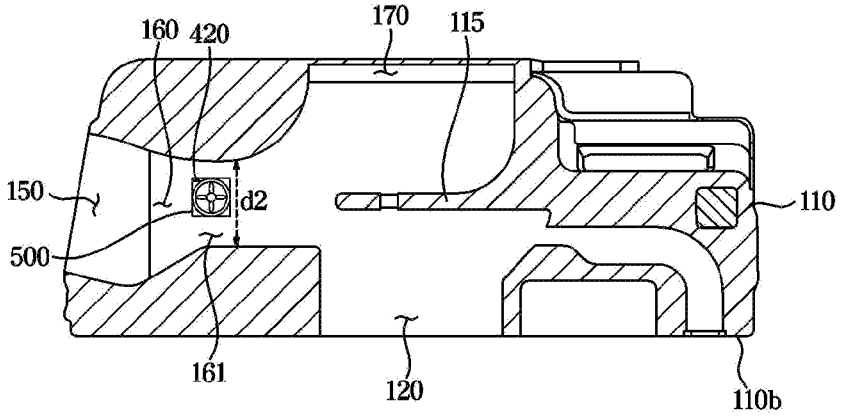
FIG. 8 is a cross-sectional view of a fridge duct in the front-to-back direction, according to another embodiment of the disclosure.

FIG. 8 is a cross-sectional view of a fridge duct in the front-to-back direction, according to another embodiment of the disclosure.

The fridge duct 100 may include an auxiliary fan 500 arranged in the smallest area 161 for the air in the fridge 22 to flow into the smallest area 161 through the connecting path 400.

When making a big difference in pressure between the inside of the fridge 22 and the smallest area 161 may not be possible due to e.g., a shape of the fridge duct 100, an amount of air in the fridge 22 flowing into the fridge duct 100 may decrease, so the cold air in the fridge duct 100 may not have a temperature higher than the dew point temperature of the cold air.

To prevent this, the auxiliary fan 500 is arranged to allow more of the air to flow into the smallest area 161, so that the temperature of the cold air in the discharge path 160 may increase to the dew point temperature or higher due to not only the difference in pressure between the fridge 22 and the smallest area 161 but also physical fluidity.

Several embodiments have been described but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

The invention claimed is:

1. A refrigerator comprising:

a main body;

first and second storage chambers with front sides open in the main body;

a first inner case defining the first storage chamber;

a second inner case defining the second storage chamber;

a cooling path formed between a rear side of the first storage chamber and a rear side of the first inner case;

an evaporator arranged in the main body to produce cold air;

a first duct supplying cold air into the first storage chamber and a second duct supplying cold air to the second storage chamber;

a connecting duct connecting the first duct to the second duct to move the cold air produced from the evaporator to the second duct; and an auxiliary blower fan arranged adjacent to the smallest area for air in the second storage chamber to flow into the smallest area through a connecting path, wherein the first duct is connected to the cooling path and comprises a blower fan provided for cold air in the cooling path to flow into the first duct and the second duct, wherein the second duct comprises a connecting port connected to the connecting duct, a discharge port through which the cold air is discharged, a discharge path connecting the connecting port to the discharge port, and the connecting path connecting inside of the second storage chamber to the discharge path, wherein the discharge path comprises a smallest area with a smallest cross-section in a vertical direction or in a front-to-back direction, and a connection flow path is arranged to connect an inside of the second storage chamber to the smallest area, wherein the discharge path includes a front section between the connecting port and the smallest area, and a rear section between the smallest area and the discharge port, and wherein a length of the rear section is formed longer than a length of the front section.

2. The refrigerator of claim 1, wherein air in the second storage chamber flows into the second duct along the connecting path.

3. The refrigerator of claim 1, wherein the second duct comprises a protruding part protruding forward, the discharge port is arranged in a front plane of the protruding part, and an one end of the connecting path is arranged in a bottom plane of the protruding part.

4. The refrigerator of claim 3, wherein the connecting path extends upward from the one end of the connecting path, and the other end of the connecting path is connected to the smallest area.

5. The refrigerator of claim 3, wherein at least a portion of the discharge path is arranged inside the protruding part, and some other portions of the discharge path extends downward.

6. The refrigerator of claim 1, wherein the first storage chamber and the second storage chamber are arranged side by side in a left-to-right direction, and the first duct is arranged on the rear side of the first storage chamber and the second duct is arranged on a rear side of the second storage chamber.

7. The refrigerator of claim 6, wherein the evaporator is arranged in the back of the first storage chamber.

8. The refrigerator of claim 6, wherein the first duct comprises a discharge port arranged adjacent to the second duct and connected to the connecting duct, and at least a portion of the cold air brought into the first duct flows into the first storage chamber and the other portions flows into the second duct through the discharge port.

* * * * *